US011219984B2

(12) United States Patent
Hall

(10) Patent No.: US 11,219,984 B2
(45) Date of Patent: Jan. 11, 2022

(54) CLAMP WITH WORKPIECE ALIGNMENT FEATURE

(71) Applicant: Taylor James Hall, Palatine, IL (US)

(72) Inventor: Taylor James Hall, Palatine, IL (US)

(73) Assignee: Nomis LLC, Palatine, IL (US)

( * ) Notice: Subject to any disclaimer, the term of this patent is extended or adjusted under 35 U.S.C. 154(b) by 384 days.

(21) Appl. No.: 16/289,124

(22) Filed: Feb. 28, 2019

(65) Prior Publication Data

US 2020/0276687 A1 Sep. 3, 2020

(51) Int. Cl.

| | |
|---|---|
| ***B25B 5/00*** | (2006.01) |
| ***B25B 5/16*** | (2006.01) |
| ***B25H 1/10*** | (2006.01) |
| ***B25H 1/08*** | (2006.01) |
| ***B25B 5/12*** | (2006.01) |
| ***B25B 5/14*** | (2006.01) |
| ***B25B 5/04*** | (2006.01) |

(52) U.S. Cl.

CPC ..... *B25B 5/16* (2013.01); *B25B 5/04* (2013.01); *B25B 5/12* (2013.01); *B25B 5/145* (2013.01); *B25H 1/08* (2013.01); *B25H 1/10* (2013.01)

(58) Field of Classification Search

CPC .... B25B 3/00; B25B 5/00; B25B 5/02; B25B 5/04; B25B 5/067; B25B 5/101; B25B 5/125; B23Q 3/00; B23Q 3/06; B23Q 3/065; B23P 11/00

See application file for complete search history.

(56) References Cited

U.S. PATENT DOCUMENTS

| | | | | |
|---|---|---|---|---|
| 1,026,475 | A | 5/1912 | Tarbuck | |
| 1,820,667 | A | 8/1931 | Leyes | |
| 1,954,708 | A | 4/1934 | Mass | |
| 2,463,966 | A | 3/1949 | Hauschild | |
| 2,577,029 | A | 12/1951 | Moorehead | |
| 2,627,787 | A | 2/1953 | Zitner | |
| 2,658,540 | A | 11/1953 | Sobaski | |
| 2,705,441 | A | 4/1955 | Armstrong | |
| 2,983,289 | A | 5/1961 | McKinley | |
| 3,124,347 | A | 3/1964 | Haddad | |
| 3,941,364 | A * | 3/1976 | Hjelm | B25B 5/12 269/156 |
| 3,984,092 | A | 10/1976 | Fitzpatrick | |
| 4,432,538 | A | 2/1984 | Sequin | |

(Continued)

OTHER PUBLICATIONS

Images of non-patent literature designs known prior to filing date of Feb. 28, 2019; 3 pages.

(Continued)

*Primary Examiner* — Lee D Wilson

(74) *Attorney, Agent, or Firm* — Reinhart Boerner Van Deuren P.C.

(57) ABSTRACT

A clamp mount and workpiece alignment apparatus is provided. Clamp including a workpiece alignment apparatus is provided. A method of clamping is provided. The clamp mount and workpiece alignment apparatus is used to mount to a support surface of a workpiece support and for positioning at least one workpiece relative to the clamp while the workpiece is supported on the support surface is provided. The apparatus includes a base, a base mount, a workpiece alignment guide, a clamp mount and an adjustable interface between the base and workpiece alignment guide.

15 Claims, 8 Drawing Sheets

(56) References Cited

U.S. PATENT DOCUMENTS

| | | | | |
|---|---|---|---|---|
| 4,470,586 | A | 9/1984 | Spencer | |
| 4,475,728 | A | 10/1984 | Haddad | |
| 4,957,402 | A | 9/1990 | Klein | |
| 4,989,654 | A | 2/1991 | Berkeley | |
| 5,165,673 | A | 11/1992 | Newton | |
| 5,443,554 | A | 8/1995 | Robert | |
| 5,584,254 | A | 12/1996 | Williams | |
| 5,617,909 | A | 4/1997 | Duginske | |
| 6,394,712 | B1 | 5/2002 | Weinstein et al. | |
| 6,715,747 | B2 | 4/2004 | Nishimura | |
| 6,932,335 | B1 * | 8/2005 | Dykstra | B25B 5/12 269/201 |
| 7,980,538 | B1 | 7/2011 | Weiby | |
| 8,104,754 | B1 | 1/2012 | Clark | |
| 8,469,343 | B2 | 6/2013 | Clark | |
| 9,120,205 | B2 | 9/2015 | Clark | |
| 9,211,635 | B2 | 12/2015 | Poole | |
| 2007/0267799 | A1 | 11/2007 | Dykstra | |
| 2016/0046001 | A1 * | 2/2016 | Clark | B25B 5/08 269/100 |
| 2020/0276687 | A1 * | 9/2020 | Hall | B25B 5/16 |
| 2020/0338694 | A1 | 10/2020 | Larkin | |

OTHER PUBLICATIONS

Kreg Tool Company; Bench Clamp Base; pages printed from the internet; date last visited May 28, 2019; https://www.kregtool.com/store/c29/bench-clamps/p433/bench-clamp-base/.

Kreg Tool Company; Bench Clamp; pages printed from the internet; date last visited May 28, 2019; https://www.ptreeusa.com/clamp_bench.htm.

Kreg Tool Company; Bench Dogs; pages printed from the internet; date last visited May 28, 2019; https://www.ptreeusa.com/clamp_bench_dogs.html.

U.S. Appl. No. 29/681,897, Hall, filed Feb. 28, 2019.

* cited by examiner

CLAMP WITH WORKPIECE ALIGNMENT FEATURE

FIELD OF THE INVENTION

This invention generally relates to tools and particularly clamps and more particularly methods and apparatus for mounting clamps to work benches.

BACKGROUND OF THE INVENTION

It is often necessary to clamp one or more workpieces to a workpiece support such as the top of a workbench such that a user, such as a woodworker, can perform activities on the workpieces. For example, a user may try to attach two workpieces that are butted against one another together such as by way of connectors.

To properly use the connectors, it can be required to form properly located holes or grooves in the workpieces that receive the connector. For example, pocket holes are often drilled at angle into one or both workpieces and then screws are inserted into the pocket holes and used to attach two workpieces together.

To properly form the pocket holes and/or insert the screws into the workpieces, it is desirous to clamp the workpieces adjacent one another. Clamps such as bench clamps have often been used to clamp workpieces to the workbench. Unfortunately, current configurations of the clamps do not provide for quick alignment of the workpieces relative to one another and to the clamp. Further, it is often required to use multiple clamps to secure multiple workpieces as it can often be difficult to properly position the clamp such that it can be used to clamp multiple workpieces while maintaining accurate alignment of the workpieces.

The present invention relates to improvements over the current state of the art as it relates to clamps and particularly clamps for clamping workpieces to a workpiece support such as the top of a workbench.

BRIEF SUMMARY OF THE INVENTION

Embodiments of the invention provide new and improved clamps, new and improved mounts for clamps and new and improved methods of clamping.

In one embodiment, a clamp mount and workpiece alignment apparatus for mounting a clamp to a support surface of a workpiece support and for positioning at least one workpiece relative to the clamp while the workpiece is supported on the support surface is provided. The apparatus includes a base, a base mount, a workpiece alignment guide, a clamp mount and an adjustable interface between the base and workpiece alignment guide.

The base mount connects to the base for mounting the base to the support surface. The workpiece alignment guide has a first guide region and a second guide region. The second guide region is orthogonal to the first guide region. The clamp mount mounts the clamp. The adjustment interface is between the base and the workpiece alignment guide for adjusting positioning of the workpiece alignment guide relative to the base between at least first and second positions. The first guide region is spaced a first distance from the clamp mount in the first fixed position and a second distance, different than the first distance, from the clamp mount in the second position.

In one embodiment, the adjustment interface includes a pin provided by either the base or the workpiece alignment guide and a plurality of spaced apart recesses provided by the other one of the base or the workpiece alignment guide. The pin is removably receivable within the plurality of spaced apart recesses to adjust the positioning of the workpiece alignment guide between the first and second positions.

In one embodiment, the workpiece alignment guide includes a midsection and first and second mounting legs extending outward from a first side of the midsection. The first and second mounting legs are axially offset from one another along a first axis that is parallel to the first guide region. The midsection and first and second mounting legs define a base gap therebetween. A portion of the base is positioned within the base gap and between the first and second mounting legs when the workpiece alignment guide is in the first and second fixed positions.

In one embodiment, the adjustment interface includes first and second pins and first and second plurality of spaced apart recesses. The first pin is provided by either the base or the first mounting leg. The first plurality of spaced apart recesses is provided by the other one of the base or the first mounting leg. The first pin is removably receivable within the first plurality of spaced apart recesses. The second pin is provided by either the base or the second mounting leg. The second plurality of spaced apart recesses is provided by the other one of the base or the second mounting leg. The second pin is removably receivable within the second plurality of spaced apart recesses.

In one embodiment, the workpiece alignment guide includes an alignment leg extending outward from a second side of the midsection. The second side is opposite the first side such that the alignment leg is on the opposite side of the midsection as the first and second mounting legs. The midsection is positioned between the alignment leg and the first and second mounting legs. The alignment leg defines the second guide region. The midsection defines the first guide region.

In one embodiment, the first mounting leg and the alignment leg are generally coaxial and located at a first end of the midsection and the second mounting leg is located at a second end of the midsection opposite the first end.

In one embodiment, the clamp mount is a first threaded shaft portion extending outward from a top of the base.

In one embodiment, the base mount is a second threaded shaft portion extending outward from a bottom of the base and a knob threadedly mounted to the second threaded shaft.

In one embodiment, the first and second threaded shaft portions are provided by a single one-piece mounting shaft extending through the base. These portions could be provided by one continuous section of threading.

In one embodiment, the mounting shaft includes a cylindrical boss located axially between the first and second threaded shaft portions, the cylindrical boss having a boss diameter that is larger than a first diameter of the first threaded shaft portion and larger than a second diameter of the second threaded shaft portion.

In one embodiment, an outer peripheral cylindrical surface of the cylindrical boss includes a plurality of axially extending grooves for engaging the workpiece support when mounted thereto.

In another embodiment, a clamp assembly is provided. The clamp assembly includes a clamp mount and workpiece alignment apparatus as outlined above and a clamp. The clamp is mounted to the clamp mount. The clamp includes a handle and a clamp head actuatable by the handle along a clamp head clamping path that is generally perpendicular to the workpiece support when mounted to the workpiece support that remains at a same orientation relative to the clamp mount when the workpiece alignment guide is in the first and second positions.

In one embodiment, the clamp handle and clamp head are on opposite sides of the clamp mount when the clamp is mounted to the clamp mount.

In one embodiment, a method of clamping workpieces using the clamp assembly as outlined above is provided. The method includes positioning, with the workpiece guide in the first position, a first side of a first workpiece against the first guide region and a second side that is perpendicular to the first side against the second guide region. The first workpiece having a third side facing opposite the first side and defining a first piece width between the first and third sides. The method includes positioning a first side of a second workpiece against the third side of the first workpiece defining a first intersection therebetween. The method includes actuating the clamp head to clamp both the first and second workpieces by overlapping the first and second work pieces at the first intersection.

In one embodiment, the method includes positioning, with the workpiece guide in the second position, a first side of a third workpiece against the first guide region and a second side of the third workpiece that is perpendicular to the first side against the second guide region. The third workpiece having a third side facing opposite the first side and defining a third workpiece width between the first and third sides of the third workpiece. The third workpiece width being different than the first workpiece width. The method includes positioning a first side of a fourth workpiece against the third side of the third workpiece defining a second intersection therebetween. The method includes actuating the clamp head to clamp both the third and fourth workpieces by overlapping the third and fourth work pieces at the second intersection.

In one embodiment, the difference between the first and second distances is equal to a difference between the first and second workpiece widths.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
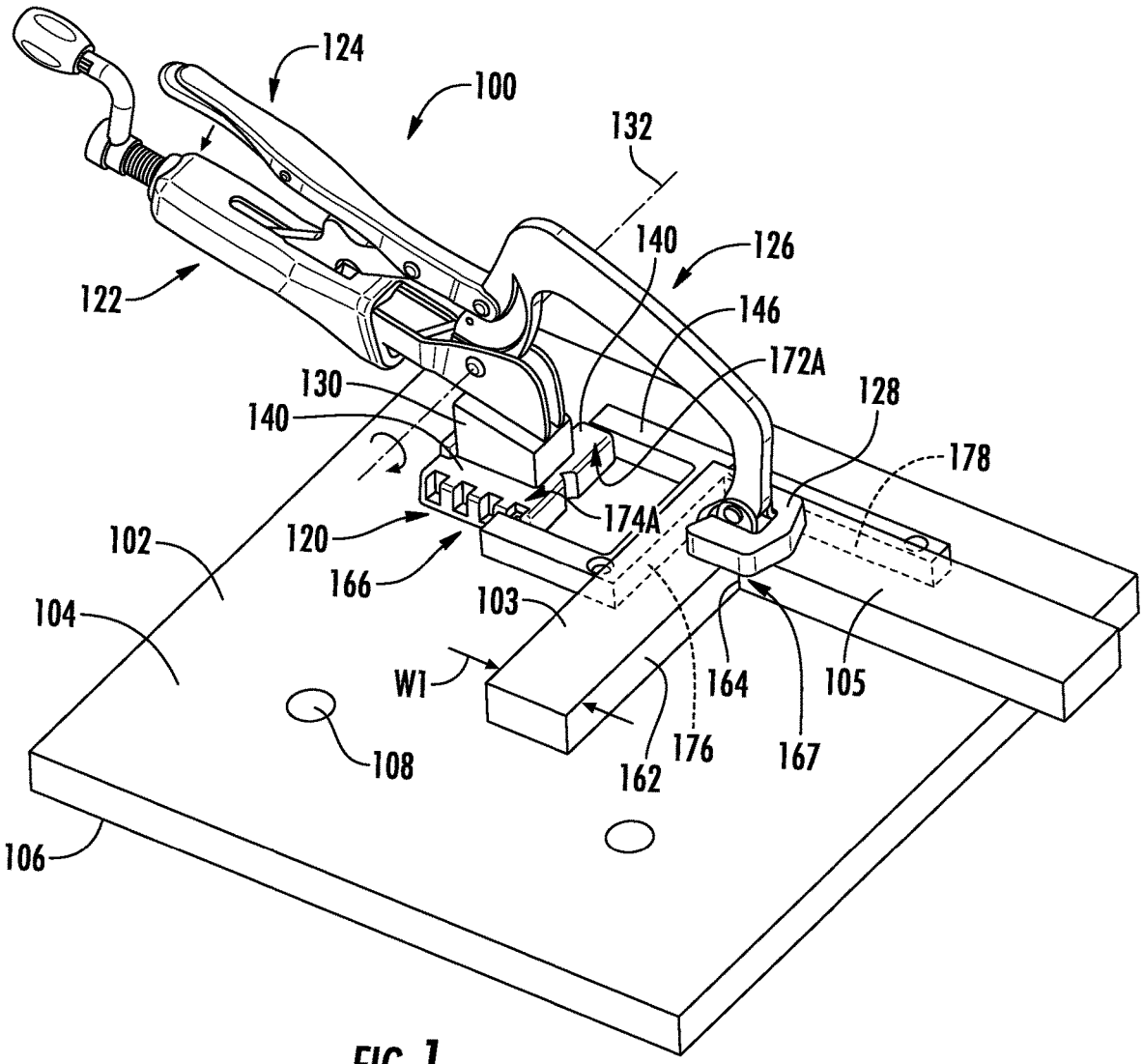
FIG. 1 is a top perspective illustration of a clamp mounted to a workpiece support according to an embodiment of the invention.

FIG. 1 illustrates a clamp 100 in the form of a bench clamp mounted to a workpiece support 102 (e.g. a top of a workbench) according to embodiments of the present invention. The workpiece support 102 includes a support surface 104, e.g. a top surface, upon which workpieces, such as boards 103, 105, can be clamped for performing activities on the workpieces 103, 105. For instance, the clamp 100 may clamp the workpieces 103, 105 adjacent to one another (as illustrated) such that the two workpieces may be affixed to one another such as by way of screws, gluing, dowling, etc.

Figure 2:
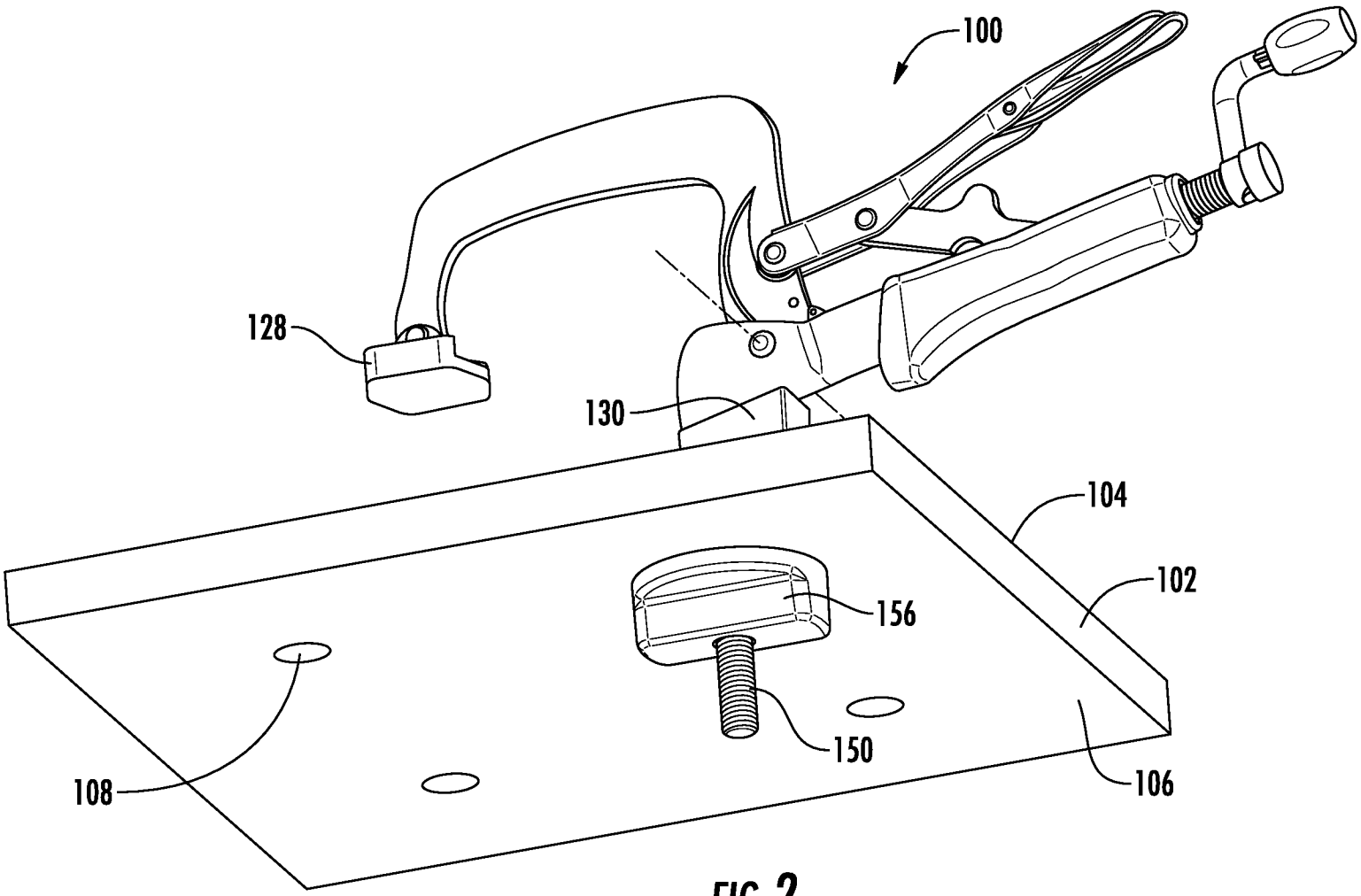
FIG. 2 is a bottom perspective illustration of the clamp mounted to the workpiece support of FIG. 1.

The workpiece support 102 has an underside 106 (see FIG. 2) opposite the support surface 104. A plurality of apertures 108 extend through the workpiece support to assist in mounting various tools, such as clamp 100 to the workpiece support 102.

Figure 3:
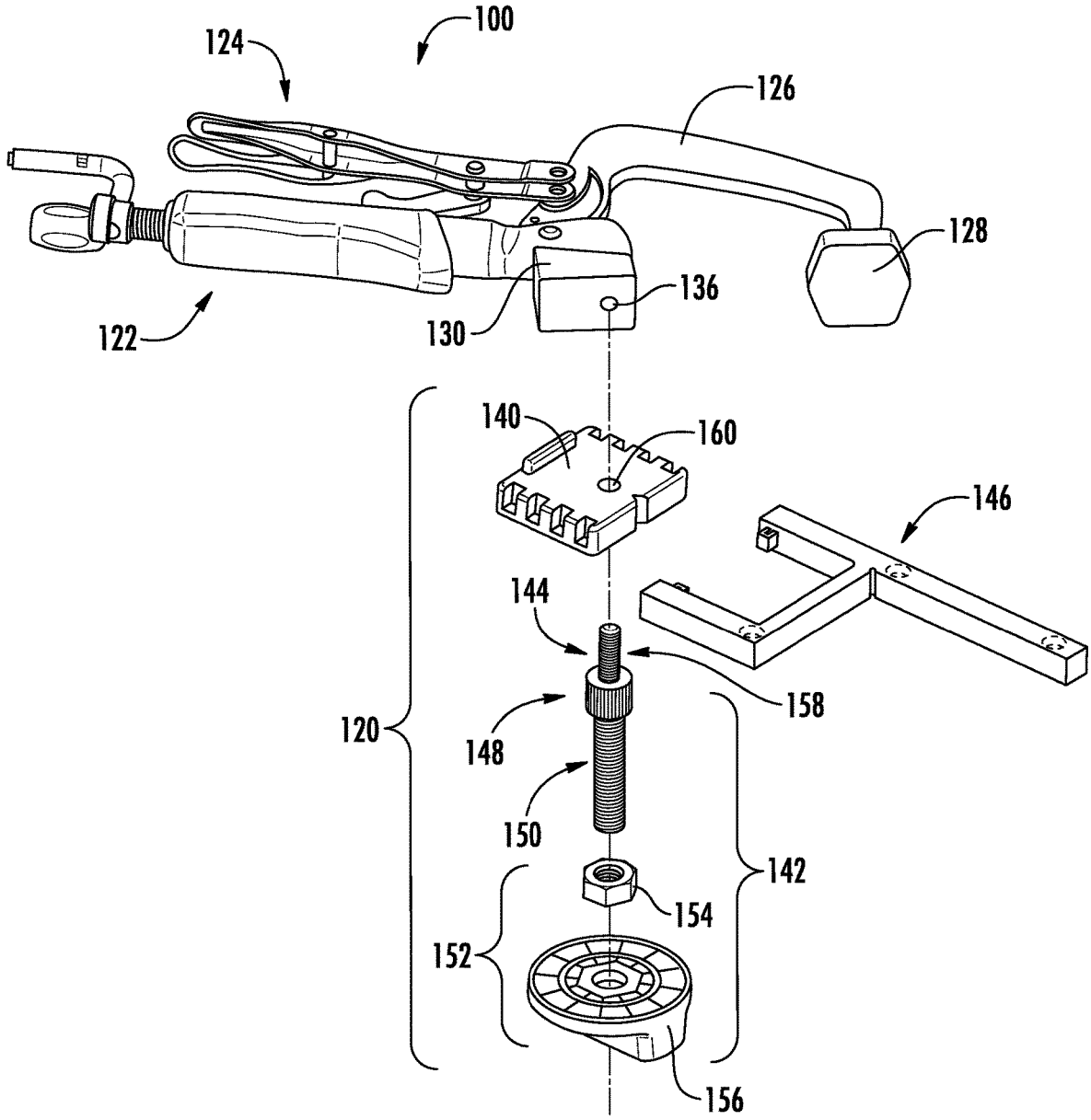
FIG. 3 is an exploded illustration of a clamp and the clamp mount and workpiece alignment apparatus used to mount the clamp to the workpiece support in FIG. 1.

With additional reference to FIG. 3, a clamp mount and workpiece alignment apparatus 120 (referred to herein to as "mount 120") is used to mount the clamp 100 to the workpiece support 102 and particularly adjacent to workpiece support surface 106. More particularly, in this embodiment, the mount 120 cooperates with the support surface 104, underside 106 and one of the aperture 108 to mount clamp 100 to the workpiece support 102.

In some embodiments, the mount 120 assists in positioning one or more workpieces relative to the clamp 100 while the workpiece is supported on a support surface 104 of a workpiece support 102.

In some embodiments, the mount 120 can be reconfigured to adjust alignment features such that different sized workpieces can be properly positioned relative to the clamp 100 and one another such that the clamp 100 can act on to provide clamping forces to both workpieces simultaneously.

With reference to FIGS. 1 and 3, the illustrated clamp 100 generally includes a handle 122, a lever arm 124, a clamp arm 126, a clamp head 128, and a clamp base 130. The handle 122 is generally fixed relative to the clamp base 130. The clamp arm 126 is pivotably connected to the clamp base 130 for pivotal movement about axis 132. Lever arm 124 operably acts between the handle 122 and the clamp arm 126 to force clamp arm 126 to pivot about the axis 132 and to bias clamp head 128 toward support surface 104 to clamp workpieces against support surface 104. While one form of a clamp is illustrated, other clamps are contemplated such as clamps that simply have a clamp head 128 that can be actuated by rotation of a threaded rod relative to a threaded base. Further, other structures for actuating the clamp head 128 are contemplated.

Clamp base 130 includes mounting structure for cooperating with the mount 120 to connect the clamp base 130 to mount 120. In this embodiment, the mounting structure is in the form of a threaded hole 136.

Mount 120 includes a base 140, a base mount 142, a clamp mount 144, and a workpiece alignment guide 146.

The base 140 rests on top of the support surface 106 in use.

The base mount 142 connects to the base 140 and mounts the base to the support surface 106. In this embodiment, the base mount 142 includes an enlarged boss 148 and a first portion of threaded rod 150. The base mount 142 also includes a knob 152 that threadedly engages the first portion of threaded rod 150.

In the illustrated embodiment, the knob 152 includes a threaded nut 154 embedded in a knob body 156. The knob body 156 is able to be gripped for user manipulation.

In the illustrated embodiment, the clamp mount 144 is in the form of a second portion of threaded rod 158 that is threadedly received in threaded hole 136 of clamp base 130.

In this embodiment, the first and second portions of threaded rod 150, 158 have different diameters with the first portion 150 having a smaller diameter than the second portion 158. Further yet, boss 148 will have a larger diameter than the first and second portions 150, 158. Further, in this embodiment, the first and second portions 150, 158 and boss 148 are formed from a one-piece component. However, in other embodiments, it is contemplated that the base mount and particularly first portion of threaded rod 150 could be separate and independent from clamp mount 144, e.g. second portion of threaded rod 158. Further, in some embodiments, boss 148 need not be provided. Further yet, in some embodiments, portions 150 and 158 could be one continuous section of threading. In some embodiments, portions 150, 158 could have a same diameter.

In some embodiments, such as the illustrated embodiment, the outer peripheral surface of the boss 148 has surface features for improved engagement with the workpieces support. In this embodiment, the outer peripheral surface, e.g. cylindrical surface, of the boss 148 includes a plurality of axially extending angularly spaced apart grooves. Other surface features could be provided.

Base mount 142 is only one embodiment of a mount for attaching the mount 120 to the workpiece support 102. Other such devices are contemplated. For instance, a mount that expands in diameter could be used. For instance, two wedge shaped pieces that have tapered surfaces that when driven axially toward one another causing the pieces to move radially outward relative to one another to radially engage the inner surfaces of apertures 108 could be used.

To mount the clamp 100 to the workpiece support 102, the user will typically attach the clamp mount 144 to the clamp base 130 with the base 140 positioned between boss 148 and clamp base 130. Here, the second portion of threaded rod 158 will extend through aperture 160 in base 140.

Thereafter, the first portion of threaded rod 150 and the boss 148 will be inserted into one of the apertures 108 in the workpiece support 102. Then, the user will attach the knob 152 and tighten the knob 152 against underside 106 of the workpiece support 102. This will sandwich base 140 between clamp base 130 and the support surface 106.

With reference to FIG. 1, the workpiece alignment guide 146 properly aligns the workpieces 103, 105 relative to the clamp 100 such that when the user actuates the clamp arm 126 and clamp head 128 toward the work piece support, the clamp head 128 overlaps and axially clamps both workpieces 103, 105. More particularly, the workpiece alignment guide 146 orients the first workpiece 103 and particularly side 162 underneath clamp head 128 such that only a portion of first workpiece 103 is located underneath clamp head 128. As such, when the second workpiece 105 is butted against side 162 a portion of the second workpiece 105 is also located underneath clamp head 128.

More particularly, the interface 167 between the first and second workpieces 103, 105 is located below the clamp head 128.

The workpiece alignment guide 146 is adjustably positionable relative to the clamp 100 and/or base 140 by way of an adjustment interface 166 between the base 140 and the workpiece alignment guide 146.

Figure 4:
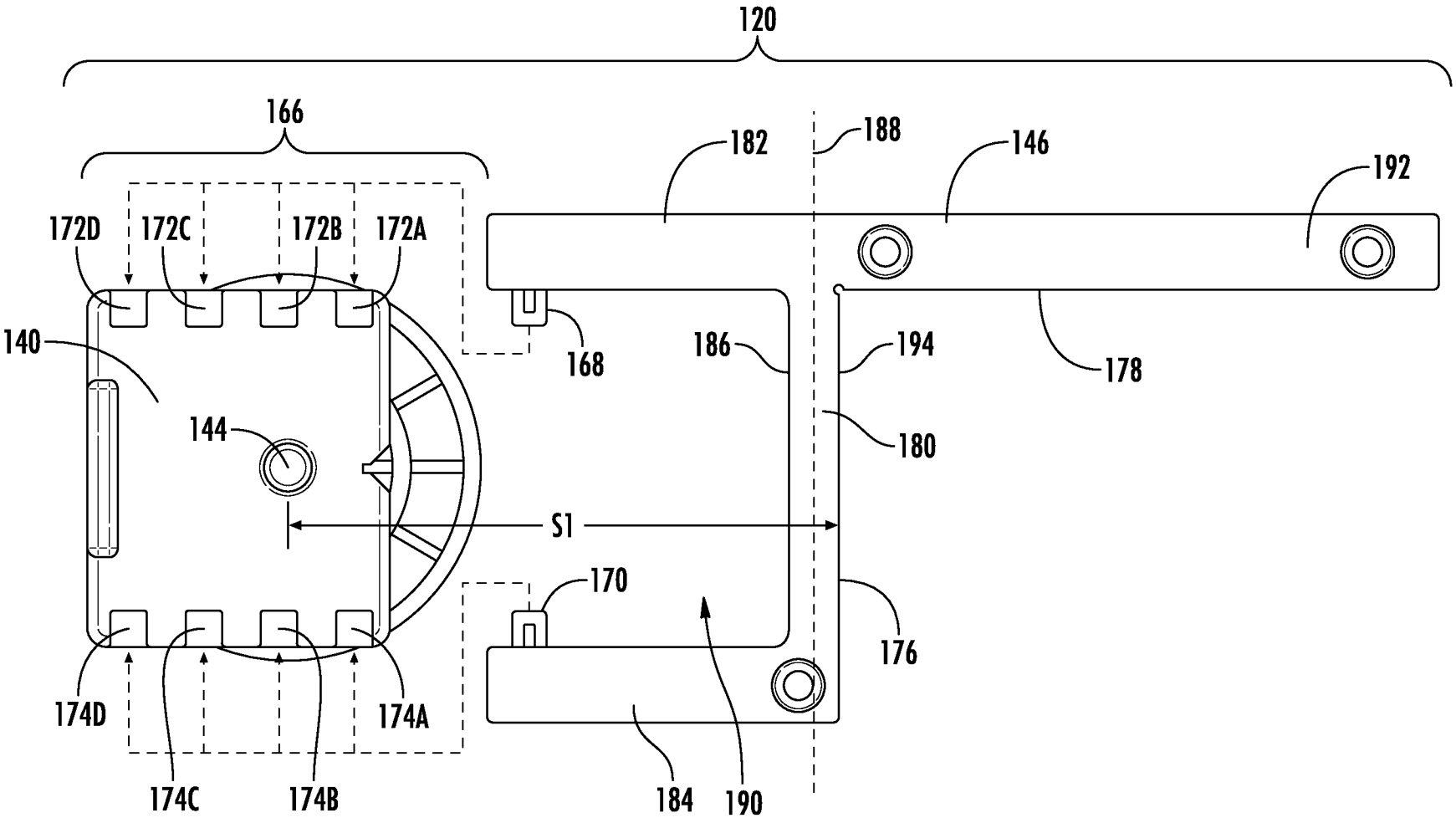
FIG. 4 is top view illustration of the clamp mount and workpiece alignment apparatus of FIG. 3.
Figure 5:
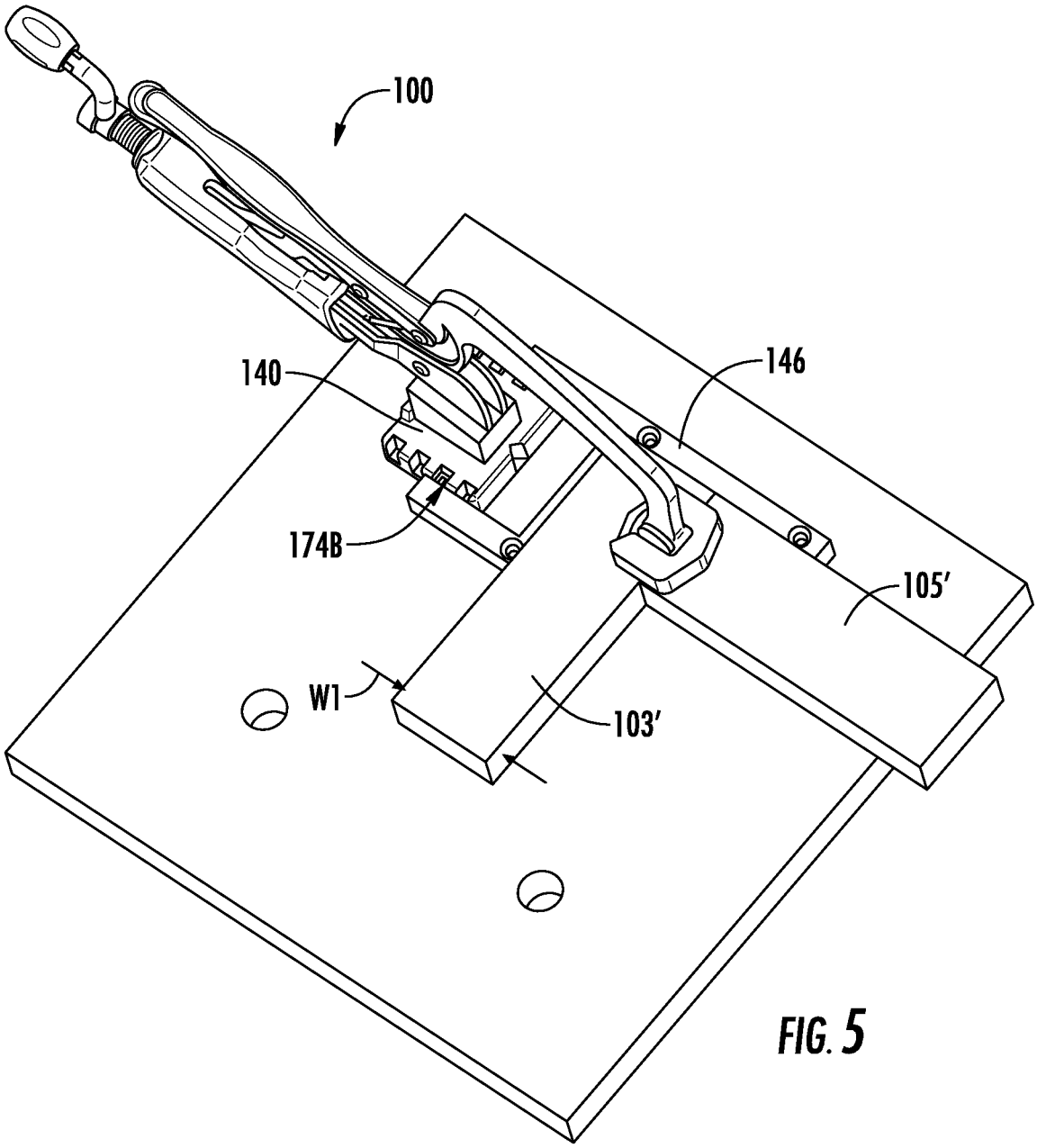
FIGS. 5-7 are alternative configurations of the clamp and workpiece alignment apparatus of FIG. 1 for clamping different sized workpieces.
Figure 6:
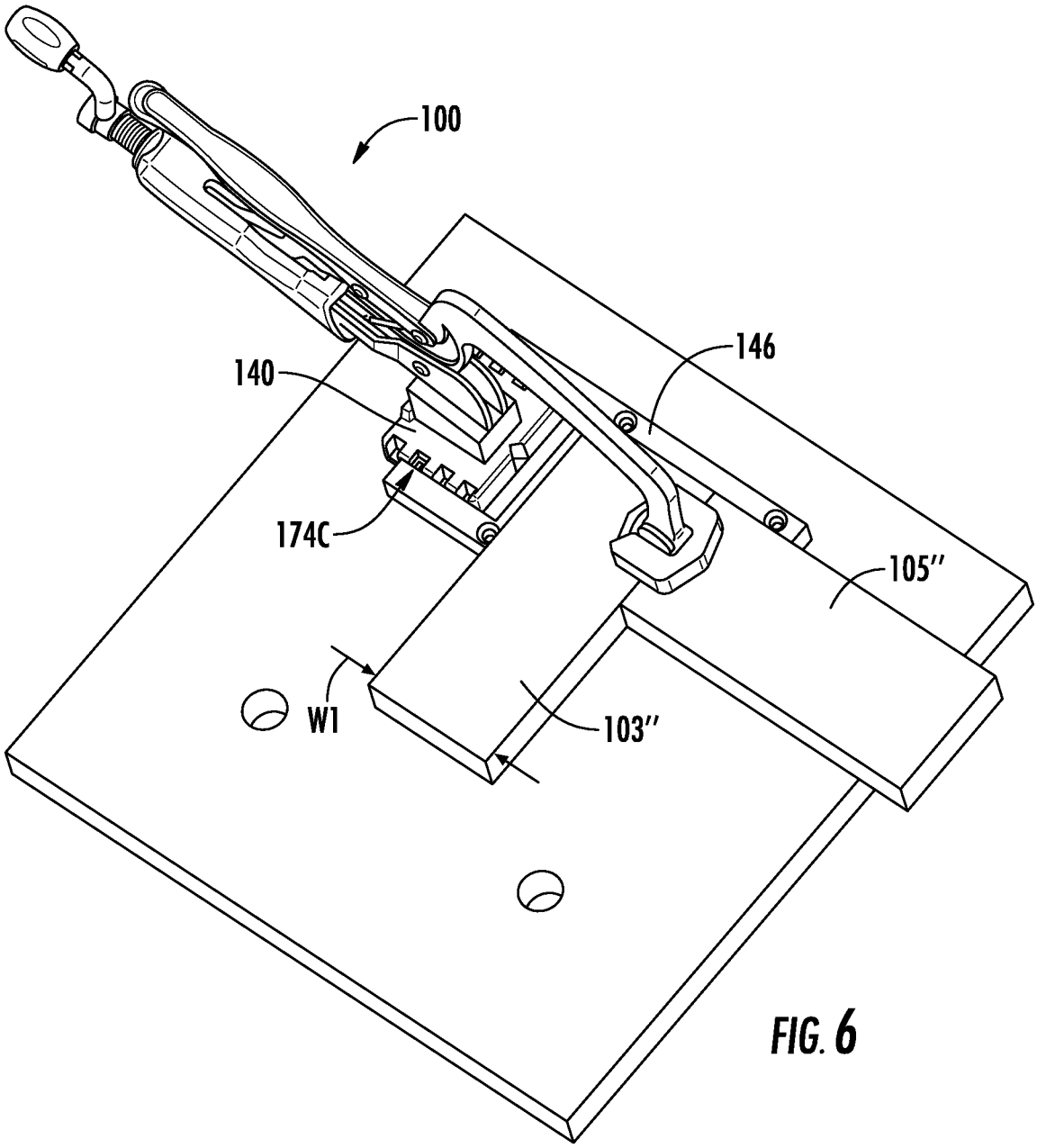
Figure 7:
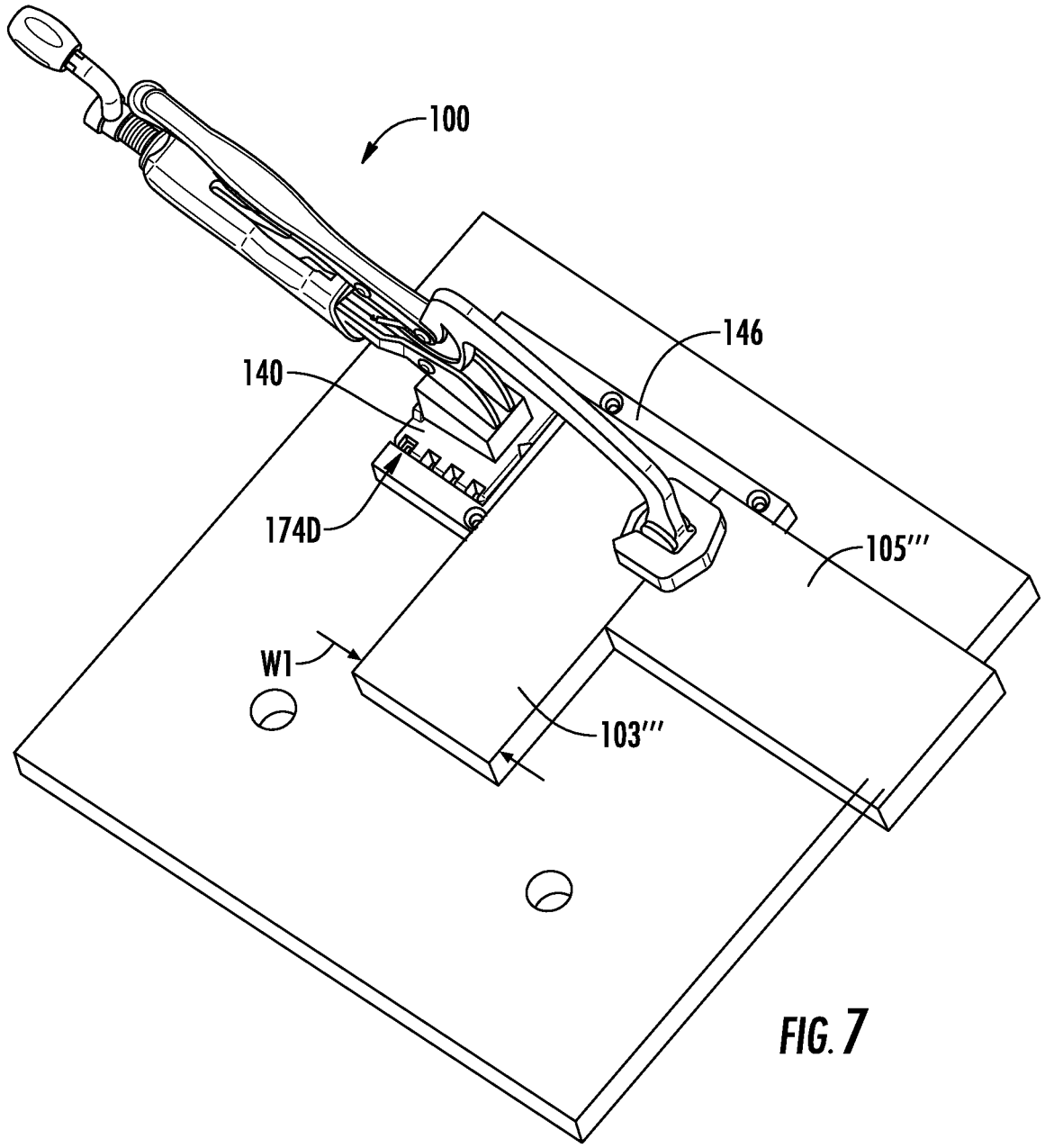
Figure 8:
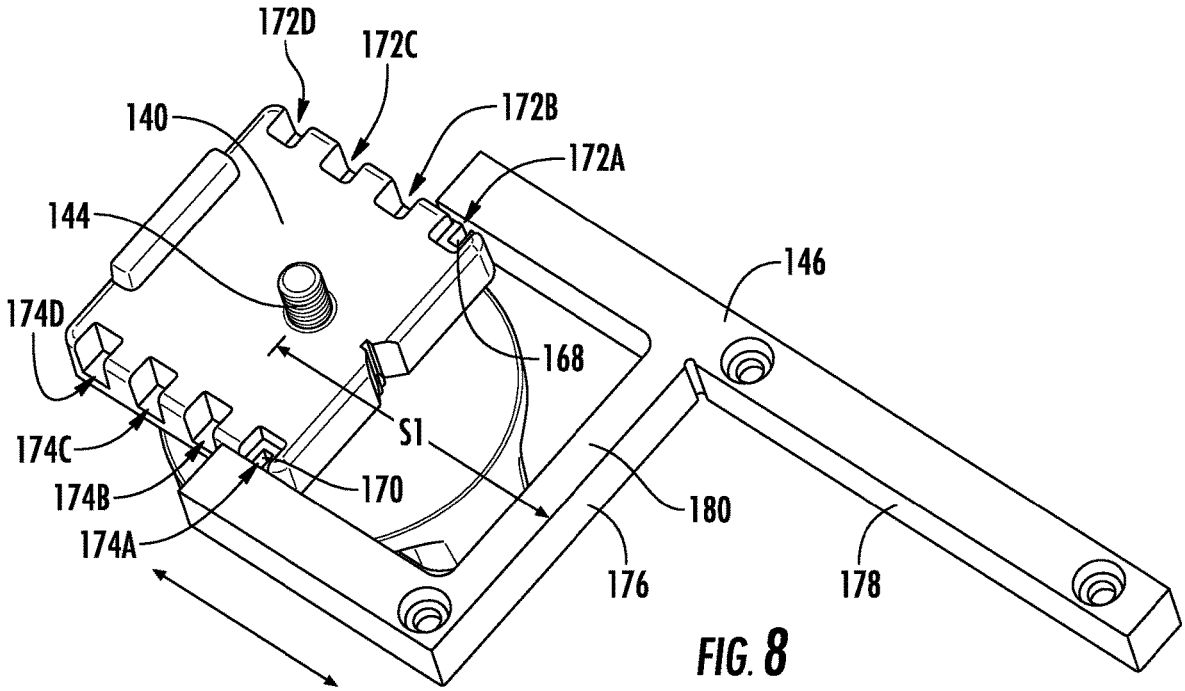
FIGS. 8 and 9 illustrate the clamp and workpiece alignment apparatus of FIG. 4 in different configurations.
Figure 9:
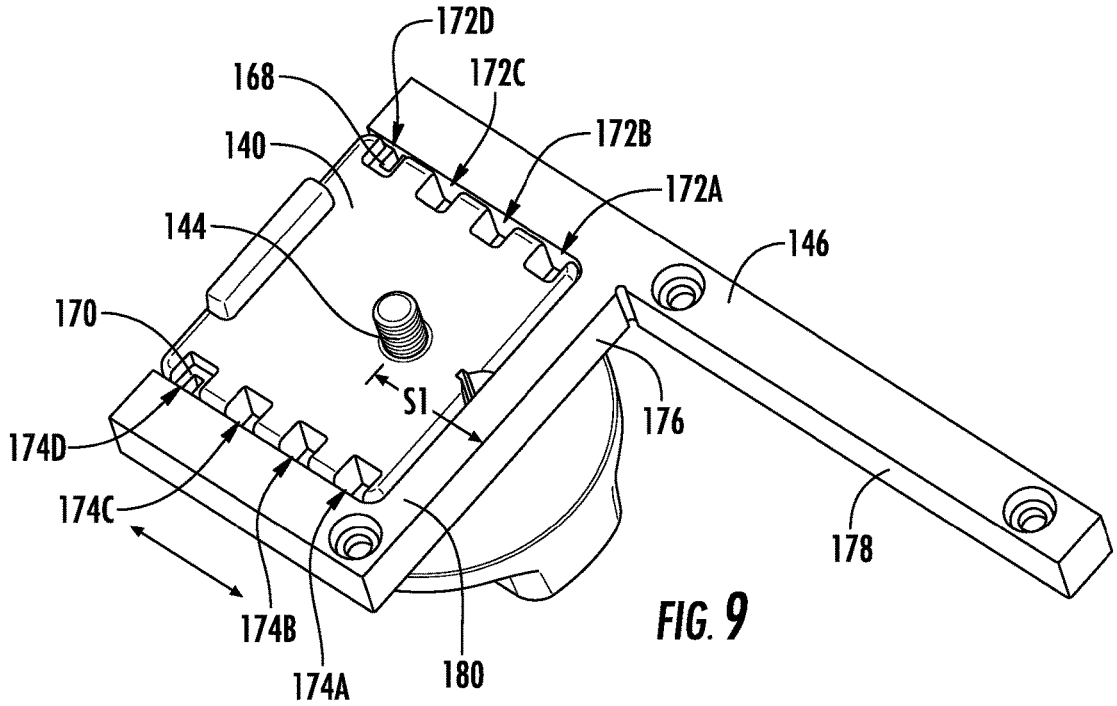

With reference to FIGS. 1 and 4, in the illustrated embodiment, the adjustment interface 166 is provided by a pair of inward extending pins in the form of projections 168, 170 that selectively cooperate with (e.g. are selectively removably receivable in) a pair of arrays of recesses 172A-172D and 174A-174D, respectively. The arrays of recesses provide individual positions for adjustably positioning the workpiece alignment guide 146. However, in other embodiments, the adjustment interface 166 could provide for infinite adjustability between extreme positions. For example, slots and pins could be provided where a knob on the pin could be used to fix the position of the workpiece alignment guide 146 relative to the clamp 100/base 140/clamp mount 144.

While the projections 168, 170 are illustrated as being part of the workpiece alignment guide 146 and the recesses 172A-172D and 174A-174D are part of the base 140, other embodiments could have this reversed.

The workpiece alignment guide 146 provides first and second guide regions 176, 178 for operably positioning the workpieces 103, 105 relative to the clamp 100 and particularly clamp head 128. In this embodiment, the first and second guide regions 176, 178 are planar walls that are orthogonal to one another that define first and second reference planes that are orthogonal to one another. The reference planes are also orthogonal to support surface 104 when the mount 120 is attached to the workpiece support 102.

Adjusting which recesses 172A-172D and 174A-174D the projections 168, 170 are positioned within adjusts the positioning of the first guide region 176 relative to clamp 100 and particularly clamp head 128. For example, the spacing S1 (see FIG. 4) between the first guide region 176 and the clamp mount 144 varies. As such, the accounts for first workpieces 103 having different widths W1 (see FIG. 1). In the illustrated embodiment, the recesses 172A-172D and 174A-174D of a given array are spaced apart by one-half inch (½") to allow for one-half inch (½") adjustment of the spacing between the clamp mount 144 and the first guide region 176. This allows for workpieces 103 of different widths in one-half inch (½") increments to be appropriately located relative to clamp head 128. More particularly, this allows first workpieces 103 of different widths W1 to be used but the interface 167 between the first and second workpieces 103, 105 to be properly located relative to the clamp head 128 such that the clamp head 128 overlaps and clamps both workpieces 103, 105 to the support surface 104.

While the spacing is described as being between the clamp mount 144 and the first guide region 176, the spacing could also be between a given portion of base 140 and the first guide region 176. For example, the spacing could be identified relative to a front side of the base, a rear side of the base, one of the recesses 172, 174 of the base etc. The clamp mount 144 is simply used as an example. Further, this spacing (i.e. distance between the first guide region 176 and point of reference) could be zero in some embodiments.

The first and second guide regions 176, 178 of the illustrated embodiment define first and second reference planes for locating the first and second workpieces 103, 105.

With reference to FIGS. 1 and 5-7, in the illustrated embodiment, recesses 172A and 174A are used for a first workpieces 103 with a width W1 of approximately one and a half inches (1.5") and each successive set of recesses (see FIGS. 5-7) is used for first work pieces 103 with increasing width W1 in one-half inch increments such that recesses 172D and 174D are used for a first workpiece with width W1 of three inches (3"). Thus, a user can switch between different workpiece sizes (see e.g. workpieces 103, 103', 103", 103''', 105, 105', 105" and 105''') by adjusting the positioning of the workpiece alignment guide 146.

With reference to FIG. 4, the workpiece alignment guide 146 is generally h-shaped.

More particularly, the workpiece alignment guide 146 includes a midsection 180 and first and second mounting legs 182, 184. The legs 182, 184 extend outward from a first side 186 the midsection 180. The midsection 180 extends longitudinally between opposed ends. The first and second mounting legs 182, 184 are axially offset from one another along a first axis 188 that is generally parallel to first guide region 176 and the reference plane defined thereby.

Typically, the first and second legs 182, 184 extend from the midsection 180 in parallel to one another.

The first and second legs 182, 184 and midsection 180 define a base gap 190 therebetween. When the workpiece alignment guide 146 is attached to base 140, a portion of base 140 is received within base gap 190. Depending on the desired positioning of the first guide region 176 relative to the clamp head 128, more or less of the base 140 may be positioned within base gap 190, see e.g. FIGS. 5-7 for reference.

In this embodiment, projections 168, 170 extend laterally inward from inner sides of the corresponding first and second leg 182, 184 into base gap 190. In alternative embodiments, the first and second legs 182, 184, for example, could provide the arrays of recesses while the base provides the corresponding projections 168, 170 that cooperate with the arrays of recesses.

In addition to legs 182, 184 a third leg 192 in the form of an alignment leg extends from the midsection 180 on a side 194 that is opposite side 186. The third leg 192 provides the second guide region 178 that aligns an end of the first workpiece 103 with a side of the second workpiece 105.

In the illustrated embodiment, the third leg 192 is generally coaxial with the first leg 182. However, this is not necessary in all embodiments.

As noted above, other adjustment interfaces are contemplated. While fixed projections 168, 170 are illustrated, these projections could be spring loaded such that a user can retract them from the recesses by pulling on a knob and then release the projections when aligned with a desired knob. As noted above, the arrays of recesses could be replaced with slots and the pins could have handles that can be tighten to allow for infinite adjustability between a plurality of different positions in which the alignment guide can be fixed relative to the base 140/clamp 100.

Further, other mechanisms for securing the clamp to the base are contemplated. For example, the base could have a bell shaped slot and the clamp could have a corresponding member that is sized to be received through the enlarged portion of the bell shape but not through the smaller portion of the bell shape. This would allow for easy mounting and unmounting of the clamp relative to the base.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A clamp mount and workpiece alignment apparatus for mounting a clamp to a support surface of a workpiece support and for positioning at least one workpiece relative to the clamp while the workpiece is supported on the support surface, the apparatus comprising:

a base;

a base mount connected to the base for mounting the base to the support surface;

a workpiece alignment guide having a first guide region and a second guide region, the second guide region being orthogonal to the first guide region;

a clamp mount for mounting the clamp;

an adjustment interface between the base and the workpiece alignment guide for adjusting positioning of the workpiece alignment guide relative to the base between at least first and second positions, the first guide region being spaced a first distance from the clamp mount in the first position and a second distance, different than the first distance, from the clamp mount in the second position; and wherein the workpiece alignment guide includes a midsection and first and second mounting legs extending outward from a first side of the midsection, the first and second mounting legs are axially offset from one another along a first axis that is parallel to the first guide region, the midsection and first and second mounting leas defining a base gap therebetween, a portion of the base being positioned within the base gap and between the first and second mounting legs when the workpiece alignment guide is in the first and second positions.

2. The clamp mount and workpiece alignment apparatus of claim 1, wherein the adjustment interface includes:

a first pin provided by either the base or the first mounting leg and a first plurality of spaced apart recesses provided by the other one of the base or the first mounting leg, the first pin removably receivable within the first plurality of spaced apart recesses; and a second pin provided by either the base or the second mounting leg and a second plurality of spaced apart recesses provided by the other one of the base or the second mounting leg, the second pin removably receivable within the second plurality of spaced apart recesses.

3. The clamp mount and workpiece alignment apparatus of claim 1, wherein:

the workpiece alignment guide includes an alignment leg extending outward from a second side of the midsection, the second side being opposite the first side, the alignment leg defines the second guide region; and the midsection defines the first guide region.

4. The clamp mount and workpiece alignment apparatus of claim 3, wherein the first mounting leg and the alignment leg are generally coaxial and located at a first end of the midsection and the second mounting leg is located at a second end of the midsection opposite the first end.

5. A clamp mount and workpiece alignment apparatus for mounting a clamp to a support surface of a workpiece support and for positioning at least one workpiece relative to the clamp while the workpiece is supported on the support surface, the apparatus comprising:

a base;

a base mount connected to the base for mounting the base to the support surface;

a workpiece alignment guide having a first guide region and a second guide region, the second guide region being orthogonal to the first guide region;

a clamp mount for mounting the clamp;

an adjustment interface between the base and the workpiece alignment guide for adjusting positioning of the workpiece alignment guide relative to the base between at least first and second positions, the first guide region being spaced a first distance from the clamp mount in the first position and a second distance, different than the first distance, from the clamp mount in the second position; and wherein the clamp mount is a first threaded shaft portion extending outward from a top of the base.

6. The clamp mount and workpiece alignment apparatus of claim 5, wherein the adjustment interface includes a pin provided by either the base or the workpiece alignment guide and a plurality of spaced apart recesses provided by the other one of the base or the workpiece alignment guide, the pin removably receivable within the plurality of spaced apart recesses to adjust the positioning of the workpiece alignment guide between the first and second positions.

7. The clamp mount and workpiece alignment apparatus of claim 5, wherein the base mount is a second threaded shaft portion extending outward from a bottom of the base and a knob threadedly mounted to the second threaded shaft.

8. The clamp mount and workpiece alignment apparatus of claim 7, wherein the first and second threaded shaft portions are provided by a single one-piece mounting shaft extending through the base.

9. The clamp mount and workpiece alignment apparatus of claim 8, wherein the mounting shaft includes a cylindrical boss located axially between the first and second threaded shaft portions, the cylindrical boss having a boss diameter that is larger than a first diameter of the first threaded shaft portion and larger than a second diameter of the second threaded shaft portion.

10. The clamp mount and workpiece alignment apparatus of claim 9, wherein an outer peripheral cylindrical surface of the cylindrical boss includes a plurality of axially extending grooves for engaging the workpiece support when mounted thereto.

11. A clamp assembly comprising:

a clamp mount and workpiece alignment apparatus comprising:

a base;

a base mount connected to the base for mounting the base to the support surface;

a workpiece alignment guide having a first guide region and a second guide region, the second guide region being orthogonal to the first guide region;

a clamp mount for mounting the clamp; and an adjustment interface between the base and the workpiece alignment guide for adjusting positioning of the workpiece alignment guide relative to the base between at least first and second positions, the first guide region being spaced a first distance from the clamp mount in the first position and a second distance, different than the first distance, from the clamp mount in the second position; and a clamp mounted to the clamp mount, the clamp including a handle and a clamp head actuatable by the handle along a clamp head clamping path that is generally perpendicular to the workpiece support when mounted to the workpiece support that remains at a same orientation relative to the clamp mount when the workpiece alignment guide is in the first and second positions.

12. The clamp assembly of claim 11, wherein the clamp handle and clamp head are on opposite sides of the clamp mount when the clamp is mounted to the clamp mount.

13. A method clamping workpieces using the clamp assembly of claim 11, the method comprising:

positioning, with the workpiece guide in the first position, a first side of a first workpiece against the first guide region and a second side that is perpendicular to the first side against the second guide region, the first workpiece having a third side facing opposite the first side and defining a first piece width between the first and third sides;

positioning a first side of a second workpiece against the third side of the first workpiece defining a first intersection therebetween; and actuating the clamp head to clamp both the first and second workpieces by overlapping the first and second work pieces at the first intersection.

14. The method of claim 13, further comprising:

positioning, with the workpiece guide in the second position, a first side of a third workpiece against the first guide region and a second side of the third workpiece that is perpendicular to the first side against the second guide region, the third workpiece having a third side facing opposite the first side and defining a third workpiece width between the first and third sides of the third workpiece, the third workpiece width being different than the first workpiece width;

positioning a first side of a fourth workpiece against the third side of the third workpiece defining a second intersection therebetween; and actuating the clamp head to clamp both the third and fourth workpieces by overlapping the third and fourth work pieces at the second intersection.

15. The method of claim 13, wherein the difference between the first and second distances is equal to a difference between the first and second workpiece widths.

* * * * *